United States Patent [19]

Pascoe

[11] 4,181,278

[45] Jan. 1, 1980

[54] RAILROAD INTERLOCKING SIGNAL SYSTEM WITH INSULATED JOINT FAILURE AND OVERRUN PROTECTION

[75] Inventor: Robert D. Pascoe, Upper St. Clair Township, Allegheny County, Pa.

[73] Assignee: Westinghouse Air Brake Company, Swissvale, Pa.

[21] Appl. No.: 928,946

[22] Filed: Jul. 28, 1978

[51] Int. Cl.[2] ..... B61L 19/16; B61L 21/06

[52] U.S. Cl. ..... 246/34 R; 246/131; 246/134

[58] Field of Search ..... 246/34 R, 34 CT, 25, 246/106, 114 R, 114 A, 131, 134, 133, 146, 219

[56] References Cited

U.S. PATENT DOCUMENTS 3,937,427 2/1976 Buzzard ..... 246/34 R

FOREIGN PATENT DOCUMENTS 737669 1/1967 Italy .

825536 10/1968 Italy .

*Primary Examiner*—Reinhard J. Eisenzopf

*Attorney, Agent, or Firm*—A. G. Williamson, Jr.; R. W. McIntire, Jr,

[57] ABSTRACT

Insulated joint failure detectors are placed at each controlled signal location in the railroad interlocking to detect the condition of the insulated joints and also the passage of each truck of a train moving in either direction past that signal. Contacts individually responsive to detector operation serially control the lockout of cab signal transmitters to inhibit the transmission of cab signal commands within the interlocking if an insulated joint fails or an unauthorized train overruns a controlled signal. These detector contacts are individually bypassed by parallel circuit paths, controlled either by the corresponding home signal relay or cab signal control relays properly energized along an established route, in order to prevent lockout when the train is authorized to pass that signal location.

9 Claims, 2 Drawing Figures

RAILROAD INTERLOCKING SIGNAL SYSTEM WITH INSULATED JOINT FAILURE AND OVERRUN PROTECTION

BACKGROUND OF THE INVENTION

My invention pertains to a signal system for railroad interlockings. More specifically, the invention pertains to a railroad interlocking signaling system including cab signals and with added insulated joint failure and train overrun protection.

Signaling systems for railroad interlockings pose special problems in maintaining fail-safe characteristics. This is due primarily to the many routes available in the interlocking track layout and to the cross connection between the rails at switch turnouts and rail crossings. It is also a problem to provide continuous cab signal energy for train movements along the various routes through the interlocking. This matter is usually solved by providing a plurality of cab signal transmitters which are selectively located at various signal locations and consecutively energized in advance of a train moving along an established route so that more than one transmitter may be involved in providing commands for a particular train movement. Because of the numerous insulated joints required in an interlocking and particularly at each entrance/exit point, the failure or breakdown of an insulated joint may cause serious cross feeds between track circuits, particularly of the cab signal energy from the various transmitters. It is important then that the detection of an insulated joint failure be incorporated into the control circuits, particularly for the cab signal energy, to prevent the supply of improper commands into a track section from another adjoining section. Another problem is the possibility of the overrun of an entry signal by a second train not authorized to move into the interlocking. If this second train enters along a route conflicting with that already established, obviously a dangerous condition may exist. It is possible that the second train may receive cab signal commands intended for the first train because of the plurality of successively energized cab signal transmitters needed for some routes. There is a need therefore to detect the overrun condition and halt all cab signal transmissions. Ideally and desirably, both conditions may be detected with the same apparatus which inhibits the supply of cab signal energy under either fault condition.

OBJECTS AND SUMMARY OF THE INVENTION

Accordingly, an object of my invention is an improved signaling system for railroad interlockings which includes insulated joint failure and overrun protection.

Another object of the invention is a railroad interlocking control system with insulated joint failure detectors to inhibit the transmission of signal commands to a train when an insulated joint failure occurs.

A further object of the invention is to incorporate overrun detection means into a railroad interlocking control system in order to inhibit the transmission of movement commands if an unauthorized train enters the interlocking track layout.

Still another object of the invention is a signaling system to control train movements through a railroad interlocking which includes a common detection means for insulated joint failure and train overrun which inhibits the transmission of movement commands if either fault condition occurs.

It is also an object of the invention to incorporate an insulated joint breakdown detector into the signal control system for a railroad interlocking to detect insulated joint failure or train overrun of an entry signal and inhibit the transmission of any cab signal commands if either event is detected.

Other objects, advantages, and features of the invention will become apparent from the following specification and appended claims when taken with the accompanying drawings.

The invention lies in incorporating, into a signaling control system for a railroad interlocking, apparatus which detects in a fail-safe manner the breakdown of any one insulated joint at an entry point to the interlocking or the unauthorized passage of a train past the associated entry signal. This apparatus responds to any such potential danger condition by inhibiting the transmission of all cab signal commands within the interlocking limits, thus halting all train movements until the fault condition can be corrected. The detection of the failure of an insulated joint may also be used to prevent false energization of an adjoining track circuit when two element or phase selective track circuits are not in use.

In practicing the invention, apparatus for detecting the breakdown of the insulated joint in either rail is coupled to the rails at each home or control signal location which controls movement of trains into or through the interlocking. In a single (illustrated) or double crossover or a simple turnout, these locations mark the outer limits of, i.e., the entrances into, the interlocking area. The detection means or apparatus is also responsive to detect the passage of each truck of a railroad car, that is, the passage of each closely adjacent pair of axle-wheel sets, independent of car body resistance. The interlocking control system to which the arrangement of the invention is added is conventional, with route selection actuating the establishment of the desired route by positioning switches, checking the occupancy condition of the various track sections along the route, and finally clearing the entry signal and any intermediate signals when all conditions are proper to authorize the movement of a train along that route. The control system also supplies cab signal commands to trains in order to provide continuous control for such apparatus through the interlocking equivalent to that in the approach sections, that is, the stretch between the various interlockings. In conventional fashion, the selected cab signal transmitters are actuated as the train enters the interlocking and occupies the corresponding track sections. Where the route includes a crossover to another track, more than one transmitter is actuated in succession as the train traverses the route and occupies successive sections. The selective energization of the successive cab signal transmitters is controlled by circuit networks which are responsive to the establishment of the corresponding route. In other words, these networks are responsive to the switches being properly aligned, the entry signal cleared which denotes that the route is unoccupied, any preceding transmitters along the route actuated, and the occupancy of the specific section by an authorized train.

As arranged by the invention, the energization of all cab signal transmitters is directly controlled or completed over a front contact of a lockout relay. This lockout relay is normally energized by a stick circuit serially controlled by contacts individually responsive to the insulated joint breakdown detectors. Each such contact remains closed when neither an insulated joint failure nor the immediate passage of a car truck past the insulated joints is detected by the corresponding apparatus. However, a circuit network is provided to bypass an open detector contact when the train passing the corresponding insulated joints is authorized by the interlocking control system to make such movement. These parallel circuit paths include contacts of the home signal relay, switch position repeater contacts, and contacts closed when the pertinent cab signal transmitter is properly actuated. The overall circuit network thus holds the lockout relay energized by its stick circuit when the passage of a car-truck is proper, that is, is an authorized and established train movement. If a detector contacts opens because an insulated joint has failed and thus created a potentially dangerous cross connection between track sections, or because a train has overrun a signal displaying a stop indication and thus has improperly entered the interlocking, the lockout relay becomes deenergized and releases to interrupt the energy supplied to all cab signal transmitters, thus inhibiting the transmission of any command to any train within the interlocking whether it is authorized or not. This action halts all trains safely until the detected fault condition can be found and corrected.

BRIEF DESCRIPTION OF THE DRAWINGS

Prior to defining my invention in the appended claims, I shall describe a specific signal installation embodying the invention arrangement with reference to the accompanying drawings, in which:

Figure 2:
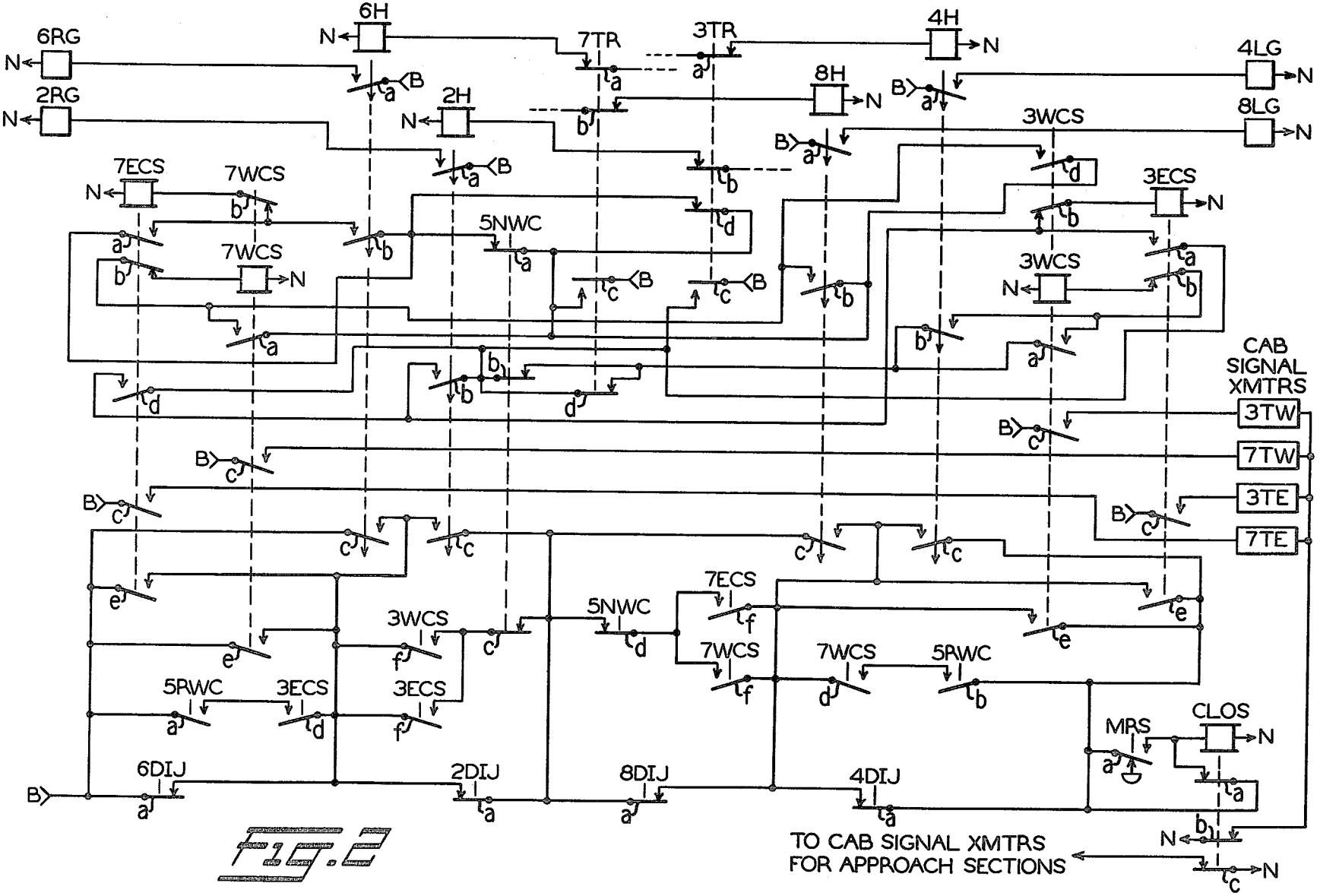
FIG. 2 is a circuit diagram of pertinent portions of the control system for the interlocking of FIG. 1 which embody and illustrate the arrangement of the invention.

In each of the drawing figures, similar reference characters refer to the same or similar parts of the apparatus. Each relay winding is shown by a conventional symbol. In general, contacts operated by a relay are in vertical alignment above or below that winding symbol. Such contacts for each relay are designated by lower case letter references unique only within the group of contacts for that relay. However, where relay contacts cannot easily be shown in line with the winding symbol or are on the other drawing figure, such contacts are designated by repeating the relay reference together with the unique lower case letter. In either form of illustration, the movable portion of a relay contact moves up to close against the associated front contact when the relay winding is energized. With the winding deenergized, the contact armatures, i.e., the movable parts, move downward to close against corresponding back contacts. Slow release relays such as relay 6H in FIG. 2 are designated by a downward pointing arrow drawn through the armature or movable portion of each contact. Such relays are characterized by holding their front contacts closed for a predetermined period of time after the relay winding is deenergized. A source of direct current energy for operating the relays of FIG. 2 is designated by the references B and N which represent the positive and negative terminals, respectively, of such source. For example, a battery and/or rectifier unit may be used but are not specifically shown since such direct current energy sources are conventional.

Figure 1:
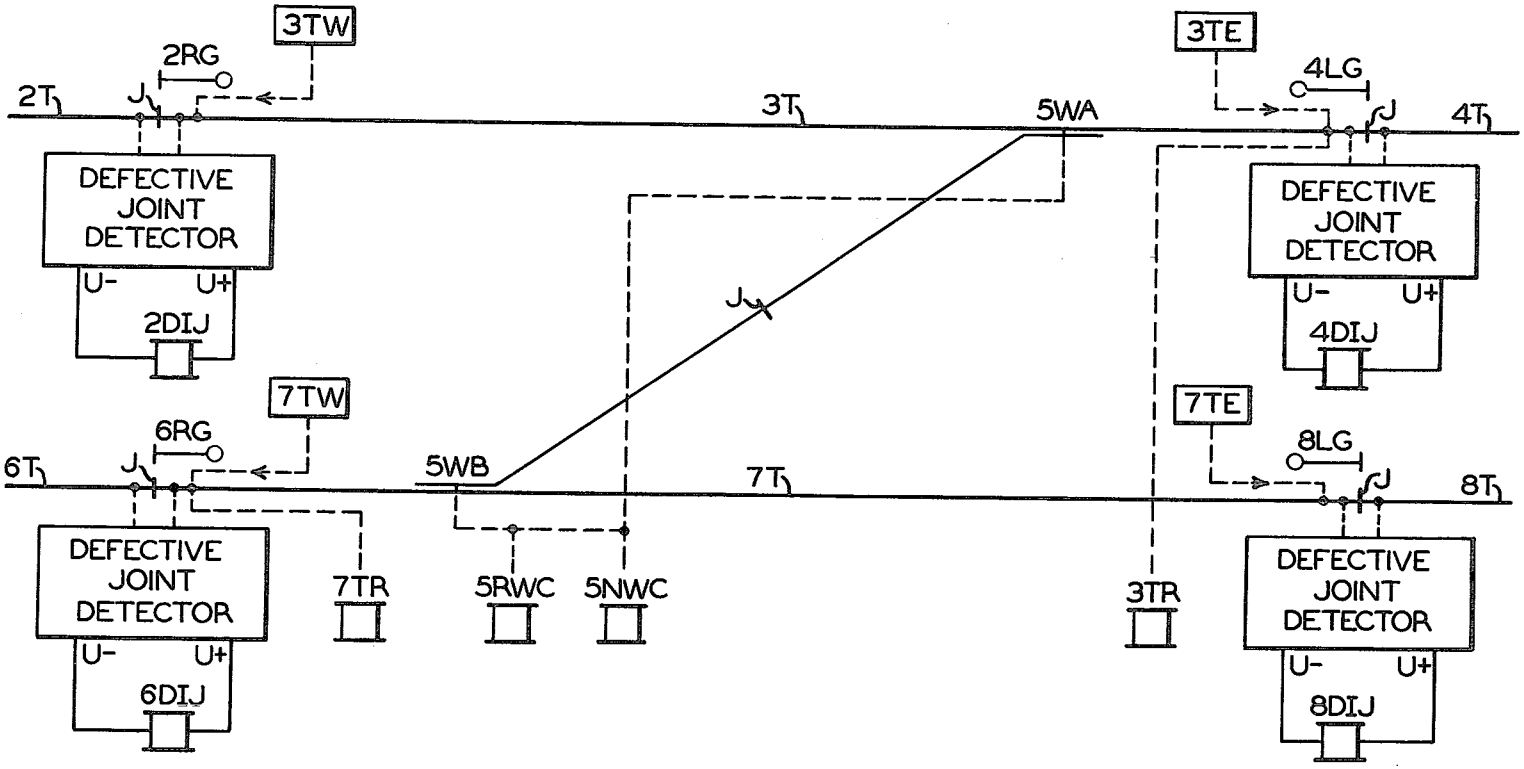
FIG. 1 is a schematic illustration of a simple railroad interlocking controlled by a signaling system embodying the invention.

Referring to FIG. 1, there is illustrated a simple railroad interlocking comprising a single crossover between two main tracks. Trains are assumed to move in either direction along each track as controlled by signal indications, with the left to right direction being designated the eastward direction. Each track is shown by a conventional single line symbol. Within the interlocking limits, the upper track comprises a track section 3T which is separated electrically from the approach sections 2T and 4T by insulated joints in both rails, shown conventionally and designated by the reference J. In the lower track, the section 7T is also separated from the approach sections 6T and 8T by similar insulated joints J. A fifth pair of insulated joints J is shown at the midpoint of the crossover to separate electrically the main track sections. Each of the sections 3T and 7T is provided with a detector track circuit of any conventional type. Each track circuit includes a track relay, for example, relays 3TR and 7TR, respectively, which is normally energized and becomes deenergized and releases when a train occupies the corresponding section. Since such arrangements are well known in the art, the track relay coupling to the rails is illustrated by a conventional dotted line. The crossover is connected to the main tracks by a pair of switches designated 5WA and 5WB. These switches may be operated by any known type of apparatus, the control of which is not pertinent to the present description. Obviously, both switches are controlled simultaneously to their normal or reverse positions. The switch positions may be detected and registered in any of various conventional and well known ways. Registry is here illustrated as being by switch correspondence relays WC, one or the other of which will be energized and picked up only when the desired and actual switch positions agree. Specifically, the normal switch correspondence relay 5NWC will be energized and picked up only when the desired route requires the crossover switches to be positioned normal and both switches have occupied that position. Conversely, the reverse correspondence relay 5RWC will be picked up only when both switches are occupying their reverse position and such positions are required by the selected route. The coupling of these relays to the two switches, since the whole arrangement is conventional in the art, is shown by conventional dotted lines.

At each interlocking outer limit along the main tracks, that is, the location of the insulated joints J, a wayside entry or home signal is positioned to govern the movement of a train into and through the interlocking at that location. Any conventional type signal with the corresponding control arrangement may be used. These signals are designated by the reference G with a distinguishing numerical prefix designating the location number and an R or L prefix in accordance with the direction of train movement controlled. Specifically, in the upper left, signal 2RG governs the movement of trains from the left into track section 3T in an eastbound direction. Incidentally, signal 2RG will also govern the continued movement of the train out of the interlocking area at the right into section 4T. A cab signal transmitter is coupled to the rails within the interlocking at each wayside signal location to supply cab signal energy to trains approaching that location through the interlocking layout. Each of these transmitters is designated by a conventional block designated by a reference including the track section symbol and a train direction symbol. For example, at the upper right, cab signal transmitter 3TE is shown coupled to the rails by a conventional dotted line to supply energy, as indicated by the arrow head, to trains approaching that location in an eastbound direction through section 3T. A conventional control arrangement for the wayside signals and the cab signal transmitters will be illustrated and discussed in connection with FIG. 2.

At each interlocking limit location, associated with the insulated joints, one in each rail, is a defective insulated joint detector device conventionally shown by a block since the specific details are not herein needed. This apparatus is coupled to both rails on both sides of the joints for determining whether each joint is in good insulating condition, i.e., electrically separating the rails of the adjoining sections, or has broken down and is in a noninsulating condition. Associated with each device is a detector relay, designated by the reference DIJ with a numerical prefix the same as the location number, for registering the condition of the joints. The relay is energized if both joints are in good condition and becomes deenergized and releases to register the failure of either joint. The type of such defective joint detector which I prefer to use is disclosed in Italian Pat. No. 825,536, granted Oct. 1, 1968. Reference is made to this patent for a full description of the apparatus if desired but it is sufficient for this disclosure to know that each defective joint detector can detect the condition of each of the pairs of joints and controls the associated detector relay to pick up and release as the joints are both good, i.e., insulating, or either joint is broken down, i.e., insulation has failed, respectively. This detector apparatus is also responsive, when adjoining section rails are coupled by a conventional impedance bond arrangement, to detect the passage of a closely spaced pair of railroad car axle-wheel units, for example, the pair of axles and wheels on each truck of a standard railroad car. When this closely spaced pair of axles spans the insulated joints, i.e., one axle shunts the rails on each side of the joints, the detector responds to release the associated DIJ relay. This response occurs regardless of the fact that both joints may be in good conditon and is independent of the resistance of the car body portions between the axles. Thus the associated relay DIJ releases and then picks up with the passage of each car-truck. This feature may be used to detect the overrun of the corresponding control or home signal by a train.

Referring now to FIG. 2, symbols representing the entry or home signal apparatus are shown in the upper left and right of the circuit diagram. Since any type of signal may be used, a conventional block illustrates each signal and represents the mechanism and all necessary control circuits for actuating the display of the appropriate indication to approaching trains. A simple control circuit over the front contact a of an associated home signal relay H, numbered the same as the signal, is illustrated. For example, signal 4LG in the upper right is energized when front contact a of relay 4H is closed. This condition causes it to display a clear or at least a proceed indication for movement of a train from section 4T into section 3T, as shown in FIG. 1. Each H relay is controlled by well known circuits which check the registry of a request for the route establishment, the occupancy of the various track sections involved, that the switches are properly positioned and locked, and such other safety conditions as may be pertinent. For purpose of this description, only the front contact of the interlocking track section relay is specifically shown in the control circuit for each H relay, with the remainder of the conventional circuitry designated by a conventional dotted line, such circuits being understood by those skilled in the art. For example, the circuit for relay 4H includes front contact a of track relay 3TR, the track section immediately in advance of the corresponding signal location, the remainder of the control circuit including the switch position detectors and the route request registry being shown by the dotted line extending to the left from the track relay front contact. Similar circuit networks exist for relays 2H, 6H, and 8H including front contact b of relay 3TR and front contacts a and b of relay 7TR, respectively.

Cab signal transmitters are shown again at the right of FIG. 2 by individual conventional blocks since the actual construction of the apparatus used depends upon the type of cab signal system in service. Each transmitter is energized, i.e., actuated, by a circuit controlled by a front contact of an associated cab signal control relay CS, the various relays being distinguished by a numerical prefix the same as that of the corresponding track section and the letter W or E to designate the direction of the train which will receive the transmitted cab signal commands. The specific location of the coupling of each transmitter to the rails is shown in FIG. 1. The circuits for all the cab signal transmitters are completed over a normally closed front contact b of the cab signal lockout stick relay CLOS, shown in the lower right of the circuit diagram. As a specific example, cab signal transmitter 3TW is energized by a circuit including front contact c of relay 3WCS and the mentioned front contact b of relay CLOS. Relay CLOS is held energized by a stick circuit including its own front contact a and, in series, front contacts a of the defective insulated joint detection relays DIJ, as shown across the bottom of FIG. 2. If deenergized and released so that its front contact a opens, relay CLOS can be reenergized, even with all front contacts a of relays DIJ closed, only by manual operation of the spring return reset push button MRS to momentarily close its normally open contact a. Other circuit paths which hold relay CLOS energized during train passage through the interlocking will be discussed later.

Each control relay CS is controlled by a circuit network which checks that the relay is involved with an established route, that the entry signal was cleared, i.e., the H relay picked up, that the switches are properly positioned, that any preceding CS relay along the route is previously energized, and that the corresponding track section is occupied. These networks are similar to the system shown in U.S. Pat. No. 3,937,427, issued Feb. 10, 1976, to Kenneth J. Buzzard for Cab Signal Control Circuits for Railroad Interlockings. By way of specific example, relay 3WCS, which picks up to energize transmitter 3TW necessary to control a westbound movement from location 4 to location 2, is controlled by a circuit including back contact b of relay 3ECS to check that an opposing cab signal command is not active, front contact b of relay 4H indicating that the entry signal at location 4 is cleared, front contact b of relay 5NWC registering that the route to location 2 is established, and back contact c of relay 3TR, which closes when the train accepts signal 4LG and enters section 3T. This circuit thus energizes relay 3WCS only when the train occupies the interlocking section. When relay 3WCS picks up, its front contact a closes to complete a stick circuit which bypasses front contact b of relay 4H so that release of this relay after the train accepts the signal will not affect the cab signal command application. If the selected route is from location 4 to location 6 over the crossover reversed, front contact d of relay 7TR, indicating the other main track clear of any train, is substituted for front contact b of relay 5NWC which will be open under this route condition. The relay is again energized only when back contact c of relay 3TR closes.

For an eastbound train movement from location 2 to location 4, relay 3ECS is energized by a circuit traced from terminal B at back contact c of relay 3TR over front contact b of relay 2H and back contact b of relay 3WCS through the winding of relay 3ECS to terminal N. When relay 3ECS picks up, its front contact a replaces front contact b of relay 2H in this circuit which then depends entirely on back contact c of relay 3TR remaining closed. If a train is moving from location 6 to location 4, the circuit for relay 3ECS still includes back contact b of relay 3WCS but now front contact d of relay 7ECS, closed only when the train has properly entered section 7T and is receiving a cab signal command from transmitter 7TW. This circuit is completed when the train moves through the crossover past the center insulated joints J and causes relay 3TR to release to close its back contact c. Similar circuits are provided for relays 7WCS and 7ECS and reference is made to FIG. 2 and the preceding discussion for an understanding of these circular networks.

I shall now discuss the control of relay CLOS during various types of train movements. It is first assumed that the train is to move from location 2 to location 4 and that all the insulated joints J are in good order, that is, are in insulating condition. All relays DIJ are thus picked up so that their front contacts a (FIG. 2) are closed to hold relay CLOS energized by its stick circuit. Front contact b of relay CLOS is thus closed to complete the energizing circuit for any cab signal transmitter otherwise closed by a corresponding CS relay. The operator now selects the desired route with entrance at location 2 and an exit at location 4. The interlocking control system checks the nonoccupied conditions of the pertinent track sections, here only secton 3T, and that no conflicting route is established. It then positions the crossover switch normal, if not already so positioned, so that relay 5NWC is picked up. As a final step, the control system, after the physical track route is established, energizes relay 2H which picks up to clear signal 2RG for the train move. This authorizes the train to enter the interlocking area at this location (2). Although not specifically shown, cab signal commands are supplied at this eastern end of section 2T to reflect this authority of the approaching train to move into the interlocking. The usual cab signal commands thus transmitted also reflect the advance traffic conditions in section 4T and beyond, but such arrangements are conventional and not described herein.

When relay 2H picks up and closes its front contact c, front contact a of relay 2DIJ is bypassed in the stick circuit for relay CLOS. When the authorized train passes signal 2RG and the insulated joints at that location, the defective joint detector responds to each two axle truck passing the joints so that relay 2DIJ intermittently releases. As the train occupies section 3T, relay 3TR releases to register this train occupancy. The opening front contact b of relay 3TR deenergizes relay 2H but the slow release characteristics of this relay hold its front contacts closed for a predetermined period. Thus relay CLOS is retained energized by front contact c of relay 2H as front contact a of relay 2DIJ opens. This contact of relay 2H thus checks that the train movement is authorized and that it is legitimate for relay CLOS to remain energized. Meanwhile, a circuit is completed for energizing relay 3ECS. At this time, the circuit includes back contact b of relay 3WCS, front contact b of relay 2H, and back contact c of relay 3TR. Front contact c of relay 3ECS closes to energize or actuate cab signal transmitter 3TE, thus supplying cab signal commands to this train within the interlocking limits, that is, within section 3T. The closing of front contact a of relay 3ECS completes the usual stick circuit so that front contact b of relay 2H is bypassed and the cab signal control relay remains energized when the signal relay eventually releases. Front contact f of relay 3ECS closes and together with front contact c of relay 5NWC, closed at this time, completes another bypass circuit path around front contact a of relay 2DIJ and also front contact c of relay 2H. This particular circuit path indicates that an authorized train is passing signal 2RG since the supply of cab signal commands is directed and the crossover switches are in their proper position. Relay CLOS is therefore held energized and cab signal commands continue to be supplied.

As this train passes out of the interlocking at location 4, the corresponding defective insulated joint detector intermittently releases relay 4DIJ but its front contact a in the network for relay CLOS is bypassed by front contact e of relay 3ECS so that relay CLOS is retained energized. Although the train is beyond the reception of the cab signal commands from transmitter 3TE at this time, the retention of relay CLOS energized is important since, if it releases, a manual reset action is required to close the reset contact a of push button MRS.

If the train movement is from location 6 to 4, the route selection action positions the crossover switches reverse and, with both sections unoccupied, picks up relay 6H to clear signal 6RG to authorize the train movement. Relay 5NWC releases and relay 5RWC picks up with the positioning of the switches to agree with the route selection. Front contact c of relay 6H at this time bypasses front contact a of relay 6DIJ in the stick circuit for relay CLOS. As the train moves past signal 6RG and occupies section 7T, relay 7TR releases. Relay 6H is thus deenergized by the opening of front contact a of relay 7TR but, because of its slow release characteristics, front contacts of relay 6H remain closed for the slow release period. Relay 6DIJ is released during the passage of the first truck of this train and intermittently thereafter. However, relay CLOS is held energized by front contact c of relay 6H during its slow release period. Relay 7ECS is energized with the closing of back contact c of relay 7TR, the circuit further including front contact d of relay 3TR, to show that the other track section in the route is unoccupied, front contact b of relay 6H, and back contact b of 7WCS to check that no opposing cab signal command is being supplied. It may be noted that front contact a of relay 5NWC is open, thus the check over front contact d of relay 3TR in this cab signal control circuit. Front contact c of relay 7ECS closes to energize transmitter 7TE to initially supply a cab signal command to this train, front contact b of relay CLOS also being closed. The closing of front contact a of relay 7ECS completes a stick circuit bypassing front contact b of relay 6H so that the cab signal control relay remains energized when the signal relay eventually releases. Likewise, front contact e of relay 7ECS bypasses both front contact a of relay 6DIJ and front contact c of relay 6H in the stick circuit which holds relay CLOS energized, it being noted that the remaining DIJ relays are presently picked up.

As this train moves through the crossover and passes joints J in the middle, it occupies track section 3T so that relay 3TR releases to register this train occupancy. Back contact c of relay 3TR closes to complete an energizing circuit for relay 3ECS which at this time, in addition to back contact b of relay 3WCS, further includes front contact d of relay 7ECS, showing that a preceding cab signal control relay was energized. This check is necessary since, the train not having entered at location 2, relay 2H is not picked up so that its front contact b is open. When relay 3ECS picks up, its front contact a completes a stick circuit which bypasses front contact b of relay 7ECS so that when the train clears section 7T relay 3ECS will remain energized. Once again, front contact c of relay 3ECS closes to energize transmitter 3TE to supply cab signal commands to the train as it traverses the crossover route and through section 3T to location 4. With front contact a of relay 5RWC closed, the closing of front contact d of relay 3ECS completes another bypass circuit around front contact a of relay 6DIJ to hold relay CLOS and the cab signal transmitters energized. This is necessary since the opening of front contact d of relay 3TR has interrupted the stick circuit for relay 7ECS which will shortly release. Front contact e of relay 3ECS provides a bypass circuit path around front contact a of relay 4DIJ, as previously described, when this latter relay intermittently releases during the passage of the train past the insulated joints at location 4. Thus once the train has entered track section 3T as it goes through the crossover, the retention of relay CLOS in an energized condition depends upon the closed front contacts of relay 3ECS.

Stepping back in time, I shall consider the situation prior to the entry of this authorized train at signal 6RG. It is assumed that a second train improperly enters the interlocking at signal 2RG, having overrun the stop signal so that at least its leading truck passes the insulated joints. It will be noted that this unauthorized train is occupying a conflicting route through the interlocking to that already established so that a potentially dangerous condition exists. Relay 2DIJ, in the usual manner, releases when the first truck of the second train passes the corresponding insulated joints. This opens front contact a of relay 2DIJ in the stick circuit for relay CLOS which then releases since no bypass circuit presently exists around this detector relay front contact. This is true under any condition since front contact c of relay 2H is open, no clearing of the signal being authorized, and front contact c of relay 5NWC is opened when the crossover was positioned reverse for the requested route. Once it is released so that its front contact a interrupts the stick circuit, relay CLOS cannot pick up even if relay 2DIJ again picks up after the lead truck passes the joint location, as previously discussed. A manual operation of push button MRS will be necessary to restore the lockout relay.

The opening of front contact b of relay CLOS interrupts the circuits for all cab signal transmitters so that no commands can be supplied within the interlocking limits. The open front contact c of relay CLOS, as indicated by the note on the drawings, may be used to interrupt similar energizing circuits for cab signal transmitters for the approach sections such as section 6T to halt the authorized train, if possible, prior to its entry at location 6. Even if the authorized train has passed signal 6RG, the improper entry of the other train into the conflicting route assuredly releases relay CLOS to interrupt the supply of cab signal commands by transmitters 7TE and/or 3TE and halt the authorized train until a check as to the fault condition may be made. This is true since only relay 6H has been picked up and all bypass circuits around front contact a of relay 2DIJ are open, even if front contact f of relay 3ECS has already been closed. In a similar manner, if a train overruns at location 8 so that relay 8DIJ releases to open its front contact a, front contact d of relay 5NWC has interrupted any bypass circuit over front contact f of relay 7ECS so that relay CLOS will also release under this condition. A second train in section 4T is detected by other control circuits in a conventional manner to halt transmission of cab signal commands by its occupancy of that section.

Failure of an insulated joint after a route is established will normally cause a lockout of the cab signal control apparatus. For example, if a joint J at location 8 fails after the route from 6 to 4 is established, and even occupied by the authorized train, the release of relay 8DIJ causes relay CLOS to release, since there is no bypass circuit path completed around front contact a of relay 8DIJ with front contact d of relay 5NWC open. The opening of front contact b of relay CLOS deenergizes all cab signal transmitters. The interruption of the operation of transmitter 7TE prevents the possibility that a westbound train waiting in section 8T at signal 8LG may improperly receive a cab signal command through the failed insulated joint at 8 and inadvertently respond to move into the interlocking along a conflicting route. The failure of any joint during a static or at-rest condition, when no routes are established, will cause the release of relay CLOS to lock out the cab signal transmitters. The joint failure must be corrected and relay CLOS manually reset to restore system operation.

Returing to the first discussed train movement from location 2 to location 4, it is to be noted that a similar lockout action will occur if a second train overruns signals 6RG or 8LG into section 7T even though the crossover switches are in their normal position. In other words, no bypass circuit exists for front contact a of relay 6DIJ since relays 6H, 7ECS, and 7WCS are not picked up and front contact b of relay 3ECS is ineffective with front contact a of relay 5RWC open. Similarly, there is no bypass circuit for front contact a of relay 8DIJ with relays 8H, 7ECS, and 7WCS released. This specific arrangement illustrated is a matter of design and choice, that is, if the system specifications require the provision of full overrun protection regardless of the original route selection. If it is desired that the overrun protection not be extended to the other main track when the crossover is positioned normal so that conflicting routes are eliminated, a second CLOS relay must be used. Under this condition, the circuit network for each CLOS relay includes cross checks to protect against conflicting movements over the crossover switches reversed. It is to be noted also that the illustrated arrangement requires only a single track circuit between control signals, for example, between signals 2RG and 4LG, which is a savings over the prior systems which require additional track circuits, and thus more insulated joints, between signals to provide effective and efficient overrun protection. It is possible, if desired, to extend the overrun lockout to the wayside signals.

The arrangement of my invention thus provides an improved interlocking signaling system for the control of train movements. By use of the defective insulated joint detector at each entry location, overrun protection is provided by inhibiting the transmission of cab signal commands if a second train improperly enters a conflicting route. The arrangement permits the use of only one track circuit between home or controlled signal locations on each main track, thus reducing the number of insulated joints. Detection of a defective insulated joint also inhibits the transmission of cab signal commands within the interlocking to prevent leakage of such commands into the approach track sections and thus the reception of improper commands by approaching trains. This new use of such detectors results in an effective and economical control system for railroad interlockings.

Although I have herein shown and discussed but one specific interlocking control system embodying the features and arrangements of my invention, it is to be understood that various changes and modifications in the system within the scope of the appended claims may be made without departing from the spirit and scope of my invention.

Having now described the invention, what I claim as new and desire to secure by Letters Patent, is:

1. In combination with a railroad interlocking control system, which includes an insulated joint in each rail at each entrance location into the interlocking layout, to electrically separate the track sections within the layout from the adjoining approach track sections, and signal transmitters coupled to the rails and actuated by the control system for authorizing train movements along a selected route when fully established and nonoccupied by another train, (a) a detection means coupled to the rails at each entrance location and responsive to the condition of the associated pair of insulated joints for operating to a first or a second condition, respectively, as said associated joints are insulating the adjoining rails or one has failed so that an electrical path exists between the adjoining rails, (1) each detection means also responsive to the passage of a train by the associated joints for intermittently operating to its second condition, and (b) lockout means operable to a first and a second position and coupled for inhibiting the operation of said signal transmitters when in its second position, (c) said lockout means normally controlled by all said detection means for holding in its first position when each said detection means occupies its first condition, (1) said lockout means further controlled by said interlocking control system for holding in its first position when a detection means detects the authorized passage of a train along an established route, (2) the detection of the unauthorized passage of a train or the failure of an associated insulated joint by a detection means operating said lockout means to its second position to inhibit the transmission of any signal by said transmitters during the detected fault condition.

2. The combination as defined in claim 1 in which, (a) said lockout means is a relay operable between energized and deenergized positions and coupled for inhibiting the operation of said transmitters when in its deenergized position, and which further includes, (b) a stick circuit network for said lockout relay normally completed, for holding said lockout relay energized, by contacts, in series, individually closed by an associated detection means when in its first condition, (c) said stick circuit further including a plurality of normally open circuit paths connected in parallel with each detection means contact and selectively closed by said control system, when a train is authorized to enter or exit said interlocking at the corresponding location, for retaining said lockout relay energized during an authorized train movement through said interlocking, (1) said plurality of circuit paths at other locations remaining open during a train movement for protecting against an unauthorized entry of another train or an insulated joint failure at that corresponding location.

3. The combination as defined in claims 1 or 2 in which, each detection means is responsive to closely adjacent wheel-axle rail shunts, one on each side of the associated insulated joints, for briefly operating to its second condition upon passage of each truck of a railroad car, independent of the level of car body resistance between the shunts.

4. A fault protection arrangement for a railroad interlocking traffic control system, to inhibit the transmission of improper train control signals when a failed insulated joint fault condition exists, comprising in combination, (a) a separate detection means coupled to the rails at each controlled signal location within the interlocking layout for detecting the condition of insulated joints electrically separating both rails at that location into control sections, (1) each detection means operable to a first or a second condition as the associated joints are in an insulating condition or either one is in a failed condition, respectively, (b) traffic control signaling means for each route through said interlocking selectively actuated by said control system for authorizing a train movement when the corresponding route is established and nonoccupied by another train, (c) said detection means being further coupled for inhibiting the actuation of any traffic control signaling means when any detection means has operated to its second condition.

5. A fault protection arrangement as defined in claim 4 in which, (a) each detection means is also responsive to the passage of each truck unit of a train for operating momentarily to its second condition, and which further includes, (b) bypass means controlled by said traffic control system and coupled for overriding the inhibition of said signaling means actuation when an authorized train moving along an established route is detected by one of said detection means.

6. A fault protection arrangement as defined in claim 5 which further includes, (a) a lockout relay coupled for inhibiting acutation of said signaling means when deenergized, (b) said lockout relay jointly controlled by all said detection means for holding the relay normally energized when each detection means is in its first condition and by said bypass means for holding the relay energized when passage of an authorized train is detected by one of said detection means.

7. A fault protection arrangement as defined in claim 6 in which, (a) each detection means controls a contact normally closed only when that means is in its first condition, and which further includes, (b) a stick circuit for said lockout relay including in series said detection means contacts to normally hold said lockout relay energized, (c) said stick circuit further including a parallel circuit path network for each detection means contact, each network controlled by said traffic control signaling system for bypassing the associated contact to hold said stick relay energized when a train is authorized to pass the corresponding location to move through the interlocking layout.

8. In a railroad interlocking control system, which includes insulated joints in the rails at each entrance location to electrically separate the rail sections within the interlocking layout, which are selectively included in established routes, from external approach rail sections, and cab signal command transmission means coupled to the rails at predetermined points within the interlocking and selectively actuated by said control system, when a route is established through the interlocking, for transmitting movement commands authorizing a train to traverse the established route, overrun protection apparatus comprising, (a) joint detection means at each insulated joint location coupled to the rails for detecting the condition of the insulated joint in each rail at that location, and operable to first and second conditions as the associated joints are in sound condition and insulating the adjoining rails or as either joint is defective and in a non-insulating condition, respectively, (b) each joint detection means also being responsive to the passage of each two axle truck of a train for momentarily operating to its second condition, (c) a lockout means operable to first and second positions and coupled to said transmission means for inhibiting the transmission of all command signals when occupying its second position, (d) said lockout means normally controlled by all said detection means for holding in its first position only when all detection means are in their first condition, (e) said lockout means further controlled by said interlocking control system for holding in its first position when a train passing a joint location is authorized to move through said interlocking and for operating to its second position when an unauthorized train passes a joint location.

9. Overrun protection apparatus as defined in claim 8 in which, (a) said lockout means is a relay operable between energized and deenergized positions, (b) an energized position contact of said lockout relay is coupled for inhibiting the actuation of said cab signal transmission means when said lockout relay becomes deenergized, and which further includes, (c) a detector relay controlled by each joint detection means for operating between a first and a second position as the associated detection means is in its first or second condition, respectively, and (d) a stick circuit network for said lockout relay comprising, (1) a principal circuit path including, in series, a first position contact of each detector relay for normally holding said lockout relay energized, and (2) a circuit network connected in parallel with each detector relay contact, and including at least one circuit path closed when a train is authorized to enter said interlocking at the corresponding location and at least one other circuit path closed when said cab signal transmission means is actuated for supplying commands for a route entering or exiting at the corresponding location, to maintain said stick circuit network closed and said lockout relay energized when the associated detector relay releases in response to the passage of an authorized train.

* * * * *